US005630471A

United States Patent [19]

Taprogge

[11] Patent Number: 5,630,471

[45] Date of Patent: May 20, 1997

[54] APPARATUS FOR TRANSFERRING CLEANING BODIES FOR A HEAT EXCHANGE THROUGH WHICH CAN FLOW A COOLING FLUID

[75] Inventor: Detlef Taprogge, Hagen, Germany

[73] Assignee: Taprogge GmbH, Wetter, Germany

[21] Appl. No.: 387,881

[22] PCT Filed: Jun. 23, 1994

[86] PCT No.: PCT/EP94/02051

§ 371 Date: Feb. 22, 1995

§ 102(e) Date: Feb. 22, 1995

[87] PCT Pub. No.: WO95/00811

PCT Pub. Date: Jan. 5, 1995

[30] Foreign Application Priority Data

Jun. 23, 1993 [DE] Germany ..... 9309320 U

[51] Int. Cl.[6] ..... F28G 1/12

[52] U.S. Cl. ..... 165/95; 15/3.51

[58] Field of Search ..... 165/95; 15/3.51, 15/3.5, 104.062

[56] References Cited

U.S. PATENT DOCUMENTS

| | | | |
|---|---|---|---|
| 3,978,917 | 9/1976 | Honma et al. . | |
| 4,544,027 | 10/1985 | Goldberg | 165/95 |
| 4,578,838 | 4/1986 | Prinz | 15/104.062 |
| 4,688,630 | 8/1987 | Borchert | 165/95 |
| 4,694,892 | 9/1987 | Borchert | 165/95 |

FOREIGN PATENT DOCUMENTS

| | | | |
|---|---|---|---|
| 148509 | 7/1985 | European Pat. Off. . | |
| 2634672 | 2/1990 | France . | |
| 1247359 | 8/1967 | Germany . | |
| 3829359 | 3/1990 | Germany | 165/95 |
| 238397 | 10/1988 | Japan | 165/95 |
| 1051367 | 10/1983 | U.S.S.R. . | |
| 1803705 | 3/1993 | U.S.S.R. . | |

*Primary Examiner*—Leonard R. Leo
*Attorney, Agent, or Firm*—Snell & Wilmer

[57] ABSTRACT

The invention relates to an apparatus for transferring cleaning bodies for a heat exchanger through which can flow a cooling fluid. The apparatus requires in the case of discontinuous operation a minimum number of drives operated with external power and has a casing which has an inlet connectable by means of a line to an outlet of the heat exchanger, as well as an outlet; a sink space, which is connected by means of a controllable closable and openable opening with the interior of the casing and an outlet connectable by means of a line to the heat exchanger inlet and a screening means located in the casing and which is positioned between the outlet of the casing on the one hand and the casing inlet on the other. The line linking the outlet of the sink space with the heat exchanger inlet contains a valve controllable by the fluid pressure, and between the outlet of the casing and an inlet of the sink space is provided a pump for delivering water from the casing to the sink space, the pressure of the fluid delivered by the pump being selected in such a way that the controllable valve opens.

10 Claims, 1 Drawing Sheet

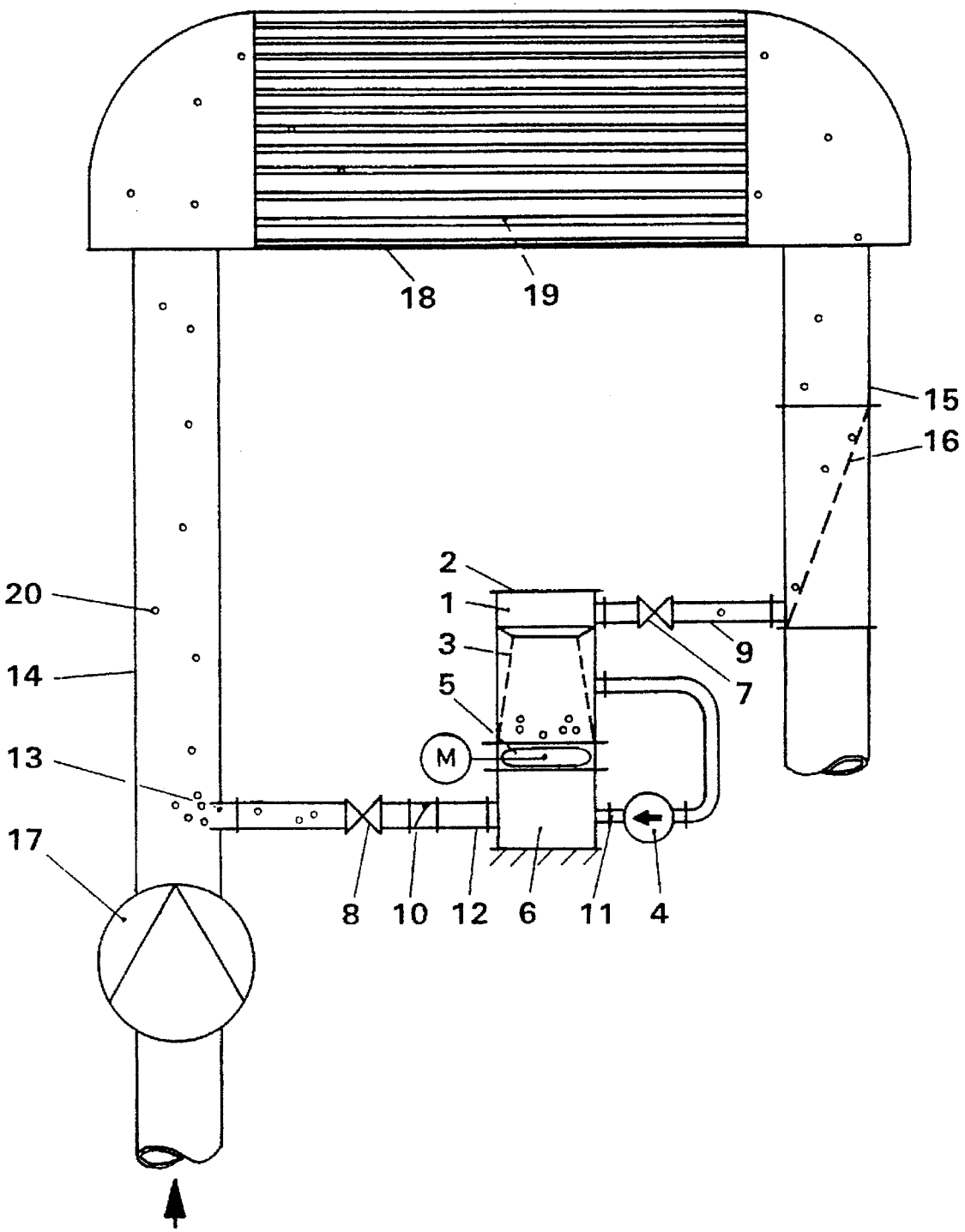
18
19
15
16
2
1
3
5
9
7
20
14
13
17
M
8
10
12
6
11
4

APPARATUS FOR TRANSFERRING CLEANING BODIES FOR A HEAT EXCHANGE THROUGH WHICH CAN FLOW A COOLING FLUID

FIELD OF THE INVENTION

The invention relates to an apparatus for the transfer of cleaning bodies for a heat exchanger through which can flow a cooling fluid in accordance with the preamble of claim 1.

BACKGROUND OF THE INVENTION

Such an apparatus is generally known from EP 148 509 A1. The flow through the apparatus is such that in spite of the use of a pump the cleaning bodies do not pass through the latter and instead take a different flow path by means of which they can be transferred back from the heat exchanger outlet to its inlet. However, for its operation it is necessary to have two motor-operated valves and a motor-operated flap for closing and opening an opening, which links the casing having the screening device with the sink space. Thus, it is necessary to provide three separate motor drives, which in particular make smaller installations more expensive. In conjunction with the sink space below the flap serving as the casing bottom there is an infeed of cleaning bodies either directly (FIGS. 1 and 2) of the reference or via a bypass (FIG. 3) of the reference into the heat exchanger inlet. When using the bypass solution the cleaning bodies are passed out of the sink space into a partial flow branched off the main cooling water flow and are transported by it into the heat exchanger inlet. The transfer flow for the return of the cleaning bodies produced with the pump and commencing at the heat exchanger outlet is passed behind the screening device via a separate line, in which the pump is located, and consequently without the cleaning bodies into the main cooling water line or into the heat exchanger inlet. The objective of this separation is to ensure that the Cleaning bodies do not have to pass through the pump which produces the transfer flow.

U.S. Pat. No. 4,079,782 discloses an apparatus in which an outlet line, in which the pump is located, is connected to the casing. The casing has on the bottom a second outlet from which can be flushed the cleaning bodies. The pump outlet is connected to the second outlet in such a way that the water delivered by the pump and sucked out of the casing "entrains", in accordance with the Jet pump principle, a flow containing the cleaning bodies from the second outlet. Also in this known apparatus, in which the cleaning bodies circulate continuously unlike in the case of the apparatus of EP 148 509 A1, the cleaning bodies do not flow through the pump.

SUMMARY OF THE INVENTION

The present invention addresses these problems by providing an apparatus for the transfer of cleaning bodies for a heat exchanger through which flows a fluid from its outlet and back to its inlet and which in the case of discontinuous operation requires a minimum number of drives operated with external power and which in particular can be of an electrical, hydraulic or pneumatic nature. However, hereinafter for simplification reasons only the term "drive" will be used.

According to an aspect of the present invention this problem is therefore addressed through an apparatus wherein in the line connecting the outlet of the sink space to the inlet of the heat exchanger a valve is located which is controllable by the pressure of the fluid and that between the casing outlet and a sink space inlet is provided a pump for delivering water from the casing into the sink space, the pressure of the fluid delivered by the pump being selected in such a way that the controllable valve opens.

In the case of the invention a return flow through the apparatus in the unintended or reversed direction is reliably prevented with the aid of the fluid pressure-controlled valve in the line linking the sink space and the heat exchanger inlet. This applies to the time periods in which the apparatus is inactive, i.e. when there is no transfer of cleaning bodies back from the heat exchanger inlet. In fact, due to the closed opening between the casing and the sink space all the cleaning bodies are trapped within the casing and there is no through-flow.

For a ball transfer period, i.e. for a cleaning period of the heat exchanger tubes, the opening preferably located in the casing bottom is appropriately opened by a flap closable by means of a drive, so that the cleaning bodies pass into the sink space. Following a predetermined opening period, whose length is empirically determined and is dependent on the sinking rate of the cleaning bodies, the flap is closed again and the pump switched on. It delivers the cleaning bodies now located in the sink space through an open check valve, which constitutes the said valve, into the heat exchanger inlet. The pump sucks fluid out of the casing, namely through the screening device between the casing inlet and the casing outlet. Suction takes place from the heat exchanger outlet and through the screen arrangement, so that above the flap are once again collected the circulating cleaning bodies and as a result of the underpressure built up by the pump they flow together with the fluid out of the heat exchanger outlet and into the casing.

After a certain time all the cleaning bodies are again trapped within the casing, so that the cleaning cycle is ended. The pump can now be switched off. On switching off the pump the fluid pressure-controlled valve at the sink space outlet and which is preferably constructed as a check valve also closes, because basically between the heat exchanger inlet and the heat exchanger outlet there is a pressure gradient adequate for closing this valve.

BRIEF DESCRIPTION OF THE DRAWING

The invention is described in greater detail hereinafter relative to a non-limitative embodiment and the attached drawing FIG. 1 which is a diagrammatic representation of an apparatus according to the invention, which is connected to a heat exchanger.

DETAILED DESCRIPTION OF PREFERRED EMBODIMENT

The apparatus, also known as a ball lock, according to the invention mainly comprises a casing 1, which is closed by a lid 2. The lid 2 can easily be dismantled and fitted with the aid of (not shown), snap closures. In the dismantled state there is free access to the interior of the casing 1, so as to be able to e.g. remove cleaning bodies 20 trapped there or introduce such cleaning bodies 20 at this point. Generally the cleaning bodies are sponge rubber balls, which can be finished in a special way, e.g. can have a strongly abrasive skin.

The bottom of the casing 1 is closed by a flap 5 operable by a drive and which in the opened state links the interior of the casing 1 with a sink space 6 located below the flap 5. The interior of the casing 1 and the sink space 6 are additionally interconnected by means of a line 11, in which is located a pump 4. The casing 1 is connected by means of a line 9 to a heat exchanger outlet 15, which in this area has a screen arrangement 16. The sink space 6 is connected by means of a line 12 to the heat exchanger inlet 14 of a heat exchanger 18. The cleaning bodies 20 passing out of the opening 13 of the line 12 are forced under the pressure of a main pump 17 through the heat exchanger tubes 19 of the exchanger 18 and with the aid of the screen arrangement 16 are again removed from the influence area of the heat exchanger 18. Each line 9 and 12 contains a cut-off valve 7, 8, which is in each case closed when the lid 2 of the casing 1 is opened.

When the apparatus is in the inoperative state a valve 10 in the line 12 constructed in the manner of a check valve is firmly closed, due to the pressure drop from the heat exchanger inlet 14 to the heat exchanger outlet 15 under the action of the main pump 17.

If the ball lock is put into operation, then the casing 1 and all the connected lines and the like are filled with water.

At the start of a cleaning cycle when the cleaning bodies 20 are to pass through the heat exchanger 18, all said cleaning bodies 20 are located in the interior of the casing 1 and are surrounded by a screening system 3. The pump 4 is switched off, and the flap 5 closes the bottom of the casing 1, which gives the position shown in the drawing. Firstly the flap 5 is opened. The cleaning bodies 20 located above it sink into the sink space 6, because their specific weight is slightly above that of water and also because there is no flow within the casing 1. Following the sinking of the cleaning bodies 20 into the sink space 6 the flap 5 is closed again, e.g. when a preset timing relay operates, its duration having been empirically determined.

The pump 4 is then switched on and its delivery pressure opens the valve 10. The pump 4 sucks the water out of the casing 1 and pumps it into the sink space 6. As a consequence thereof the cleaning bodies located in the sink space 6 are passed through the line 12 up to the opening thereof 13, where they are taken up by the medium flowing through the heat exchanger 18. Following the cleaning operation in the heat exchanger tubes 19 they are trapped with the aid of the screening device 16 and conveyed back into the area above the flap 5 within the screening means 3. The pump 4 causes the transfer through the lines 9 and 12, but no cleaning bodies 20 flow through said pump.

After the cycle of all the cleaning bodies is at an end, the pump 4 is switched off again and the apparatus is ready to operate during the next cleaning cycle. The running time of the pump 4 can once again be controlled by means of a timing relay. The next cleaning cycle can directly follow or only take place at a later time.

It was indicated hereinbefore that only two drives are necessary, e.g. a drive cylinder for operating the flap 5 and the drive for the pump 4. Both drives can be put into operation by simple sequence controls, so that there is no need for an expensive control means with program sequence or the like. During inoperative periods the fluid pressure-controlled valve 10 ensures that there is no undesired bypass flow through the heat exchanger 18 and during the periods when the cleaning bodies 20 sink from the interior of the casing 1 into the sink space 6 it ensures that no flow occurs which could affect the sinking of the cleaning bodies.

The cut-off valves 7 and 8 are relatively infrequently operated, namely only when the lid 2 of the casing 1 is opened. For this rare operation a manual actuating means can be provided, although it is more advantageous for the said valves 7 and 8 to be operated by means of a drive.

Slightly above the closed flap 5, the casing 1 can have a drain cock, so that it is easier to remove the cleaning bodies 20 when the lid 2 is removed. The drained off medium, which is e.g. cooling water, can be collected in a bucket and can be reintroduced following the removal of the cleaning bodies 20 and before closing the lid 2.

I claim:

1. Apparatus for transferring cleaning bodies for a heat exchanger through which can flow a cooling fluid, having a heat exchanger, through which a cooling fluid flows, having an inlet and an outlet, a casing (1), which has an inlet connected by means of a line (9) to the outlet of the heat exchanger, as well as an outlet and an interior.

a sink space (6), which is connected by a controllable closable and openable opening with the interior of the casing (1) and an outlet connected by means of a line (12) to the heat exchanger inlet, a screening means (3) located in the casing (1) and which is positioned between the outlet of the casing (1) on the one hand and the casing inlet on the other, characterized in that, the line (12) linking the outlet of the sink space (6) with the heat exchanger inlet contains a controllable valve (10), and that between the outlet of the casing (1) and an inlet of the sink space (6) is provided a pump (4) for delivering water from the casing (1) to the sink space (6), the pressure of the fluid delivered by the pump (4) being selected in such a way that the controllable valve (10) opens.

2. Apparatus according to claim 1, characterized in that the casing has a top and a bottom and the controllable opening is located in the bottom of the casing (1).

3. Apparatus according to claim 1, characterized in that the controllable opening is closable and openable by a movable flap (5).

4. Apparatus according to claim 1, characterized in that the fluid-controlled valve (10) is a check valve.

5. An improved heat exchanger through which a cooling fluid flows comprising:

a heat exchanger having an inlet and an outlet, a casing having an inlet and an outlet, said inlet being connected to said outlet of the said heat exchanger, a sink operably connected to said casing outlet through a first openable conduit and having an outlet operably connected to said heat exchanger inlet, a screening system suitably positioned between said casing inlet and said casing outlet, a second conduit connecting said outlet of said sink with said inlet of said heat exchanger containing a pressure controllable valve, and a third conduit operably controlled by a pump suitably positioned between said outlet of said casing and said inlet of said space.

6. The heat exchanger of claim 5 wherein said valve is located in the bottom of said casing.

7. The apparatus of claim 6 wherein said valve is configured in the form of a moveable flap.

8. The apparatus according to claim 6 wherein said valve comprises a fluid controlled valve.

9. A method for transferring cleaning bodies through a heat exchanger comprising the steps of:

providing a heat exchanger having an inlet, an outlet, a casing having an inlet and an outlet, said casing inlet connected to said heat exchanger outlet, a sink having an inlet and an outlet, said sink inlet connected by an openable conduit to said casing outlet and said sink outlet connected to said heat exchanger inlet by a second conduit including therein a pressure controllable valve, and a third conduit further connecting said casing and said sink and including therein a pump suitably positioned between the outlet of said casing and said inlet of said, providing cleaning bodies in said casing, activating a pump to deliver water from said casing to said sink at a predetermined pressure such that said valve in said outlet opens and cause said cleaning bodies to move through said sink outlet, passing said cleaning bodies through said heat exchanger but preventing the unintended return flow through said heat exchanger through selective operation of said pressure controllable valve.

10. The method of claim 9 further comprising the step of opening a flap to permit said cleaning bodies to sink from said casing to said sink prior to activating said pump.

* * * * *